US007083433B2

(12) United States Patent
Misawa et al.

(10) Patent No.: US 7,083,433 B2
(45) Date of Patent: Aug. 1, 2006

(54) ELECTRICAL CONNECTOR

(75) Inventors: Shinri Misawa, Tokyo (JP); Takeki Fukazawa, Tokyo (JP); Hisatomo Mima, Hadano (JP); Yuichi Sekino, Hadano (JP)

(73) Assignee: DDK Ltd., Tokyo (JP)

( * ) Notice: Subject to any disclaimer, the term of this patent is extended or adjusted under 35 U.S.C. 154(b) by 0 days.

(21) Appl. No.: 11/183,625

(22) Filed: Jul. 18, 2005

(65) Prior Publication Data

US 2006/0030178 A1 Feb. 9, 2006

(30) Foreign Application Priority Data

Aug. 5, 2004 (JP) ..... 2004-229438

(51) Int. Cl.
*H01R 12/00* (2006.01)

(52) U.S. Cl. ..... 439/80

(58) Field of Classification Search ..... 439/78–81, 439/290, 291, 856, 857
See application file for complete search history.

(56) References Cited

U.S. PATENT DOCUMENTS 3,011,143 A * 11/1961 Gordon ..... 439/291
3,115,379 A * 12/1963 McKee ..... 439/290
3,259,869 A * 7/1966 Batcheller ..... 439/290
4,820,182 A * 4/1989 Harwath et al. ..... 439/290
5,024,610 A * 6/1991 French et al. ..... 439/857
5,158,471 A * 10/1992 Fedder et al. ..... 439/80
5,564,952 A * 10/1996 Davis ..... 439/682
5,582,519 A * 12/1996 Buchter ..... 439/101
5,618,187 A * 4/1997 Goto ..... 439/79
5,630,720 A * 5/1997 Kocher ..... 439/78
5,667,392 A * 9/1997 Kocher et al. ..... 439/79
6,089,877 A * 7/2000 Seidel ..... 439/79
6,102,754 A * 8/2000 Capper et al. ..... 439/857
6,280,216 B1 * 8/2001 Bernier et al. ..... 439/251
6,319,075 B1 * 11/2001 Clark et al. ..... 439/825
6,383,039 B1 * 5/2002 Yoneyama et al. ..... 439/856
6,394,818 B1 * 5/2002 Smalley, Jr. ..... 439/79
6,488,549 B1 * 12/2002 Weller et al. ..... 439/856
6,776,635 B1 * 8/2004 Blanchfield et al. ..... 439/181
6,805,591 B1 * 10/2004 Garland et al. ..... 439/733.1
6,814,590 B1 * 11/2004 Minich et al. ..... 439/79
6,869,294 B1 * 3/2005 Clark et al. ..... 439/79
6,890,221 B1 * 5/2005 Wagner ..... 439/855
6,932,660 B1 * 8/2005 Roepke ..... 439/856
2002/0031925 A1 * 3/2002 Clark et al. ..... 439/79

(Continued)

FOREIGN PATENT DOCUMENTS

JP H10-189105 7/1998

(Continued)

*Primary Examiner*—Ross Gushi
(74) *Attorney, Agent, or Firm*—Baker Botts LLP

(57) ABSTRACT

The electrical connector includes a receptacle connector 10 and a plug connector 50. The receptacle connector includes a first housing 13 made of an insulating material having plate-shaped receptacle contacts 11 made of a conductive material and formed with first through-holes 12 for accommodating the plate-shaped receptacle contacts. The plug connector includes a second housing 53 made of an insulating material having plate-shaped plug contacts 51 made of a conductive material and formed with second through-holes 52 for accommodating the plate-shaped plug contacts. At least three branched contact portions 55 to 57 and 15 to 17 are provided in staggered form on both front end portions 54 and 14 of the plug contact and the receptacle contact. With this construction, the electrical connector is superior in stability of contact between the receptacle and plug contacts.

14 Claims, 9 Drawing Sheets

U.S. PATENT DOCUMENTS

| | | | | |
|---|---|---|---|---|
| 2002/0034889 | A1* | 3/2002 | Clark et al. | 439/79 |
| 2002/0187687 | A1* | 12/2002 | Weller et al. | 439/856 |
| 2002/0193019 | A1* | 12/2002 | Blanchfield et al. | 439/857 |
| 2003/0219999 | A1* | 11/2003 | Minich et al. | 439/79 |

FOREIGN PATENT DOCUMENTS

| | | |
|---|---|---|
| JP | 2003-142213 | 5/2003 |

* cited by examiner

ELECTRICAL CONNECTOR

CROSS-REFERENCE TO RELATED APPLICATIONS

This application claims priority from Japanese Patent Application No. 2004-229438, filed Aug. 5, 2004, which is incorporated by reference in its entirety.

BACKGROUND OF THE INVENTION

This invention relates to an electrical connector including a receptacle connector and a plug connector and superior in stability of contact between the receptacle and plug connectors.

In prior art electrical connectors, generally, plug contacts are blade-shaped in cross-section as shown in, for example, Japanese Patent Application Opened No. 2003-142,213 or pin-shaped in cross-section as shown in, for example, Japanese Patent Application Opened No. H10-189,105 (1998). Receptacle contacts opposite to the plug contacts each have a pair of cantilevered beams exerting inwardly directing springy forces. When connecting the connectors, the blade-shaped or pin-shaped plug contacts are inserted between beams of the receptacle contacts to achieve electrical connections.

In such electrical connectors, the contact between the plug contacts and the receptacle contacts would be maintained by embracing the plug contacts between the cantilevered beams of the receptacle contacts only utilizing the inwardly directing springy forces of the beams. Therefore, sufficient stability of contact between the plug and receptacle contacts would not be obtained. If such a stability of the contact between the plug and receptacle contacts could not be obtained, electric current will be concentrated at any contact points so that the contacts would tend to be overheated with the concentrated current. The heat resulting from the overheated contacts would be transmitted to other connector members to adversely affect even the performance of electric circuits to be connected to the electrical connector.

In an electric power connector through which comparatively heavy current, for example, more than 30 A flows, heavy current would flow between contacts so that the contacts would be overheated to higher temperatures. Accordingly, the above problems would be particularly acute in this case.

SUMMARY OF THE INVENTION

It is an object of the invention to provide an electrical connector which eliminates the disadvantages of the prior art descried above and which is particularly superior in stability of contact between receptacle and plug connectors by reasonably forming the shape of at least one of front end portions of the receptacle and plug contacts.

In order to accomplish the above object, the electrical connector according to the invention comprises a receptacle connector and a plug connector, the receptacle connector including a first housing made of an insulating material having at least one plate-shaped receptacle contact made of a conductive material and formed with a first through-hole for accommodating the plate-shaped receptacle contact, and the plug connector including a second housing made of an insulating material having at least one plate-shaped plug contact made of a conductive material and formed with a second through-hole for accommodating the plate-shaped plug contact, wherein at least three branched contact portions are provided in staggered form on at least one of front end portions of the plug contact and that of the receptacle contact.

In one embodiment of the invention, the branched contact portions may be provided only on the front end portion of the plug contact. In a preferred embodiment, the three branched contact portions are provided at the front end portion of the contact, among which the main branched contact portion positioned at the middle is wider than the side branched contact portions positioned on opposite sides of the main branched contact portion, and the front end portions of the plug and receptacle contacts are engageable with each other.

In the case that there is a need to more improve the stability of contact between the receptacle and plug contacts, preferably the branched contact portions are also provided on the front end portion of the receptacle contact, whose number is equal to that of the branched contact portions provided on the plug contact so that the plug connector is connected to the receptacle connector in a manner that the front end portion of the plug contact is conducted by the front end portion of the receptacle contact to be coupled and engaged with each other.

In order to facilitate conducting the front end portion of the plug contact to the front end portion of the receptacle contact, it is preferable that the receptacle contact is so formed that the main branched contact portion and both the side branched contact portions diverge at respective positions on the side of the front end portion when viewed from one side of the contact.

With a view to obtaining the stability of contact between the plug contact and the receptacle contact, preferably the plug contact is so formed that the main branched contact portion and both the side branched contact portions exert their springy forces in directions closing to each other at respective positions on the side of the front end portion.

In view of the heat dissipation of the contacts, preferably the first through-hole of the receptacle connector is so formed that at least one surface of the receptacle contact does not contact the first housing over the full length of the contact.

As an actual construction, the second housing of the plug connector preferably includes a plurality of plug contacts and is formed with a plurality of second through-holes whose number is equal to that of the plug contacts for accommodating the plug contacts, and the second through-holes are short holes for accommodating only the rear portions of the plug contacts so that the front portions of the plug contacts are in an open space common to all the plug contacts. In addition, preferably the second through-holes of the second housing of the plug connector are so formed that at least one surfaces of the rear portions of the plug contacts do not contact the second housing.

In a preferred embodiment of the invention, the first and second through-holes of the receptacle and plug connectors have cross-sectional shapes corresponding to the branched contact portions of the front end portions of the respective contacts, making it possible to fit the staggered branched contact portions into the first and second through-holes of the receptacle and plug connectors, respectively.

The electrical connector according to the invention has following significant functions and effects.

(1) According to the invention, by properly forming the shape of at least one of front end portions of the plug contacts and the receptacle contacts, it becomes possible to provide an electrical connector superior in stability of contact between the receptacle contacts and the plug contacts.

(2) According to the invention, moreover, the three branched contact portions are provided on each of front end portions of the plug contacts and the receptacle contacts, while the front end portions of the plug and receptacle contacts are adapted to be coupled and engaged with each other, thereby more improving the stability of contact between the plug and receptacle contacts.

(3) According to the invention, furthermore, the first through-holes of the receptacle connector are so formed that at least one surfaces of the receptacle contacts do not contact the first housing over their full lengths, and/or the plug connector includes the second housing having a plurality of plug contacts and formed with second through-holes, the number of which is equal to that of the plug contacts for accommodating the plug contacts, and the second through-holes are short holes to accommodate only the rear portions of the plug contacts so that their front portions are in an open space common to all the plug contacts and at least one surfaces of the rear portions of the plug contacts do not contact the second housing. With this construction, even if the contacts are overheated at higher temperatures, heat dissipation of the contacts is effectively promoted.

The invention will be more fully understood by referring to the following detailed specification and claims taken in connection with the appended drawings.

DESCRIPTION OF THE PREFERRED EMBODIMENTS

Figure 1:
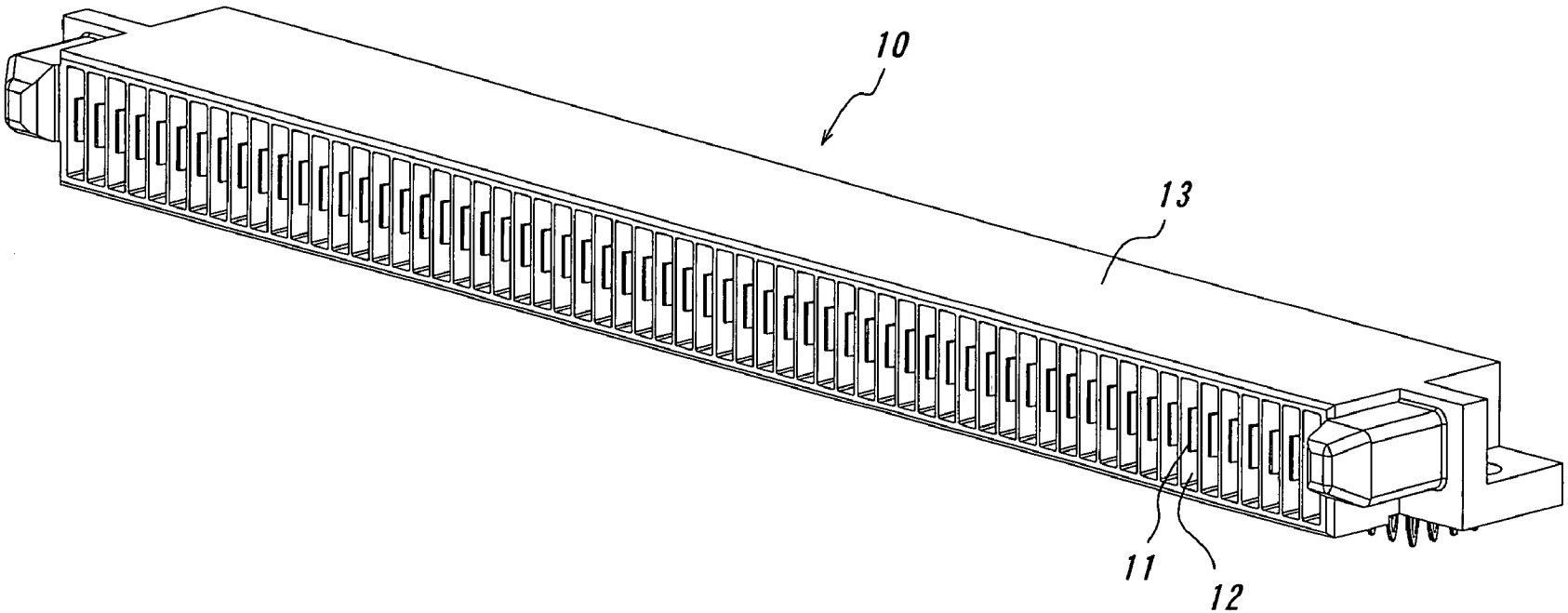
FIG. 1 is a perspective view of a receptacle connector constructing a typical electrical connector according to the invention.
Figure 2:
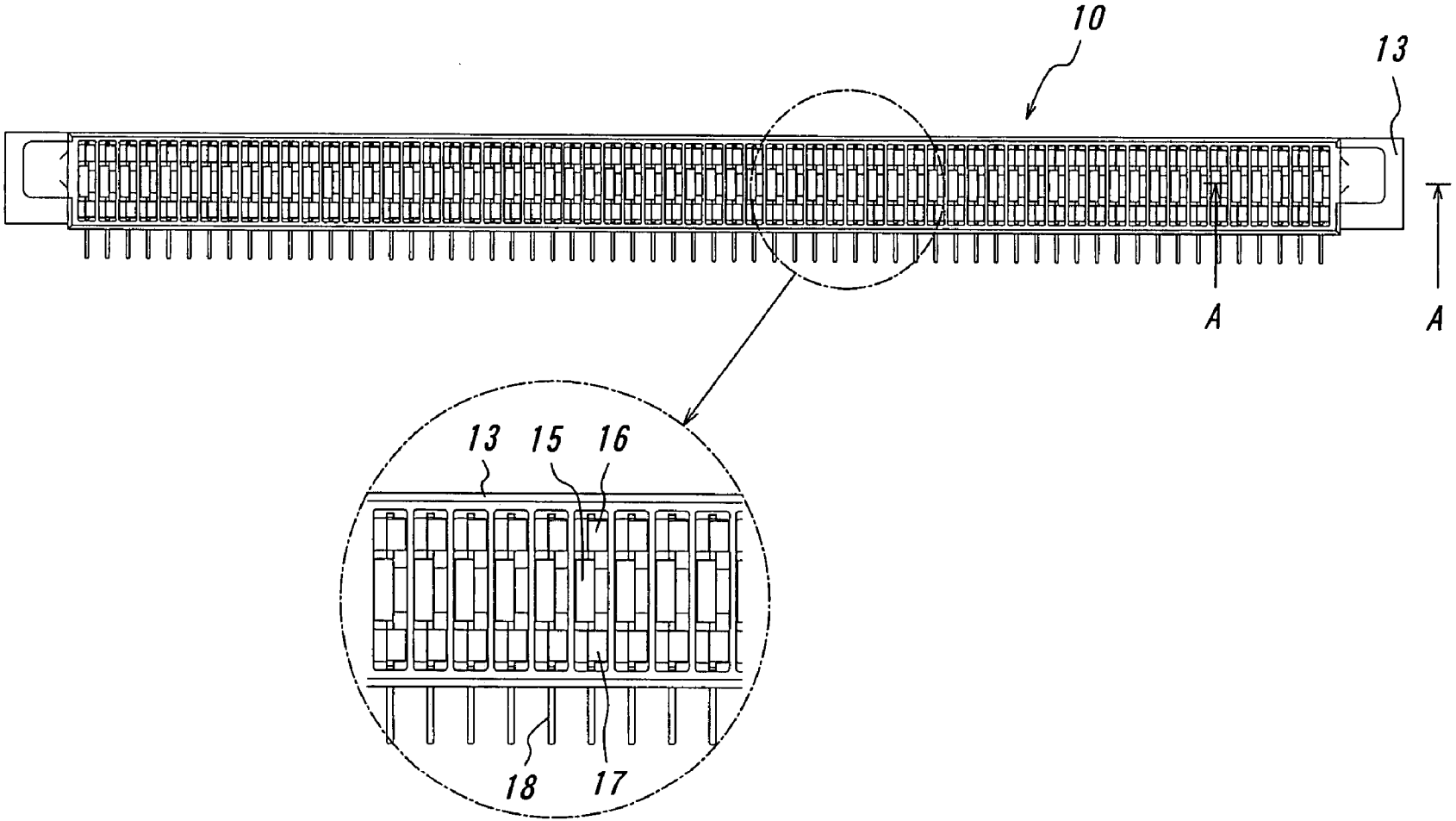
FIG. 2 is a front elevation of the receptacle connector shown in FIG. 1.
Figure 3:
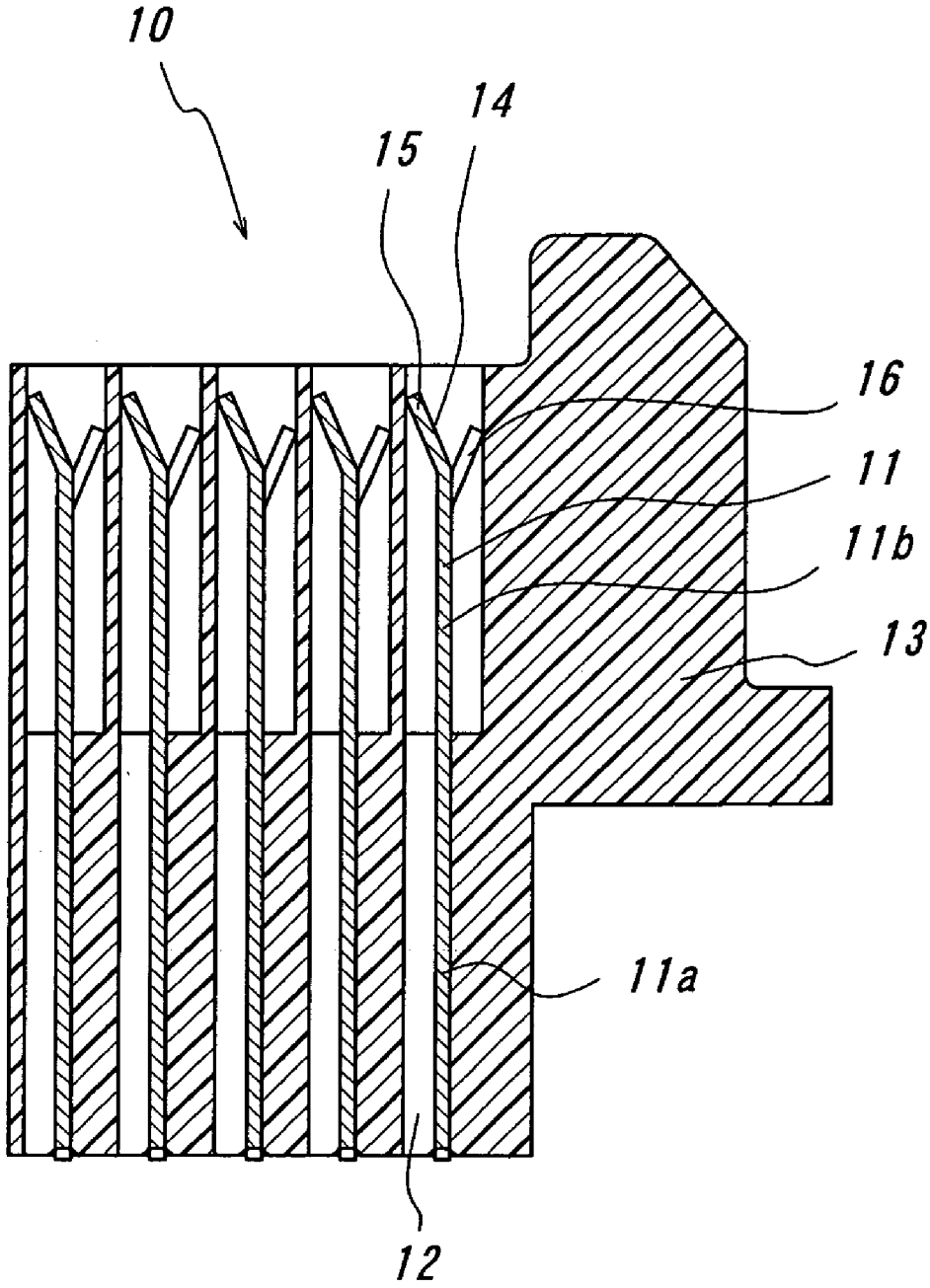
FIG. 3 is a sectional view of the receptacle connector taken along the line A—A in FIG. 2.
Figure 4:
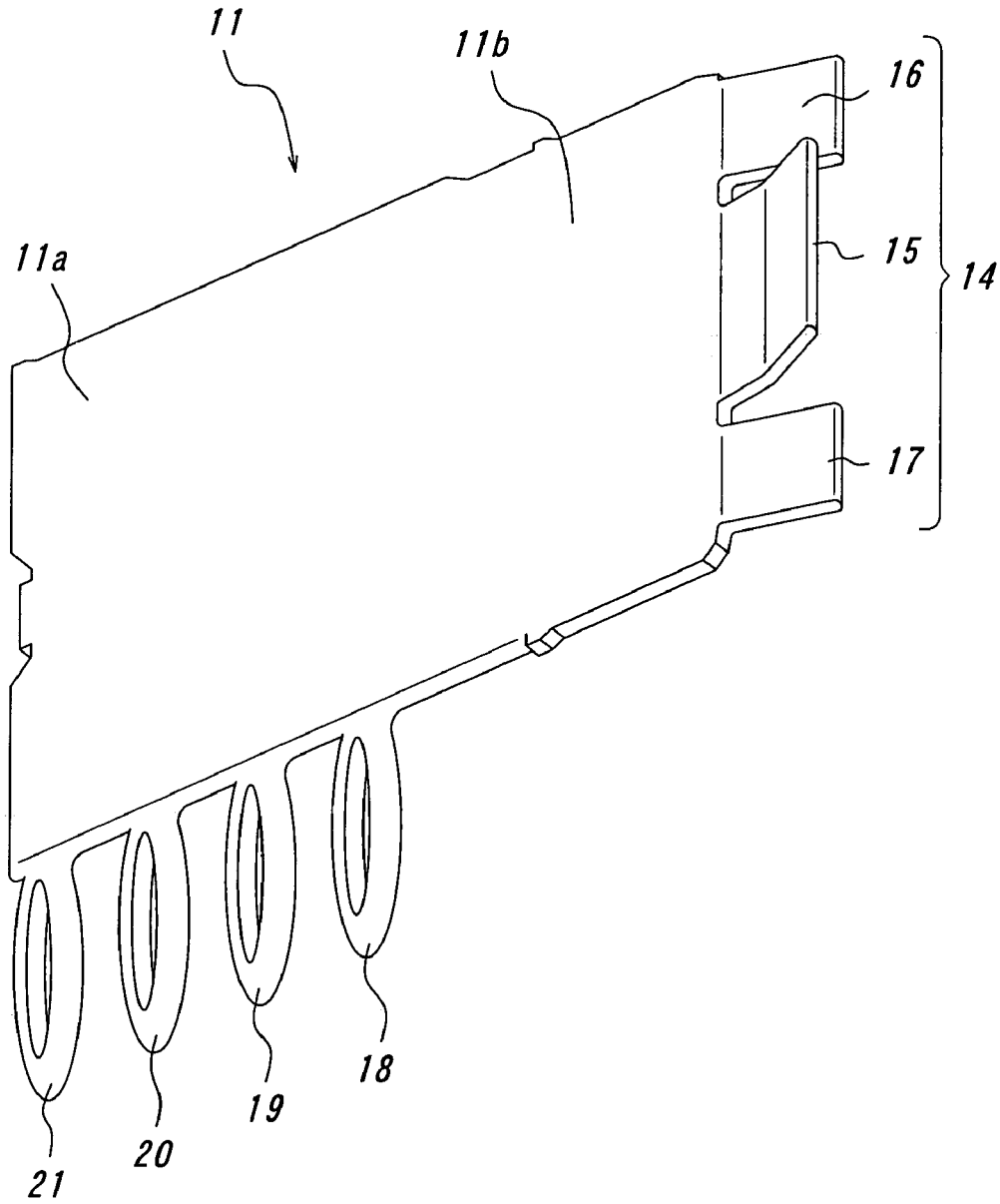
FIG. 4 is a perspective view of a receptacle contact used in the receptacle connector shown in FIG. 1.
Figure 5:
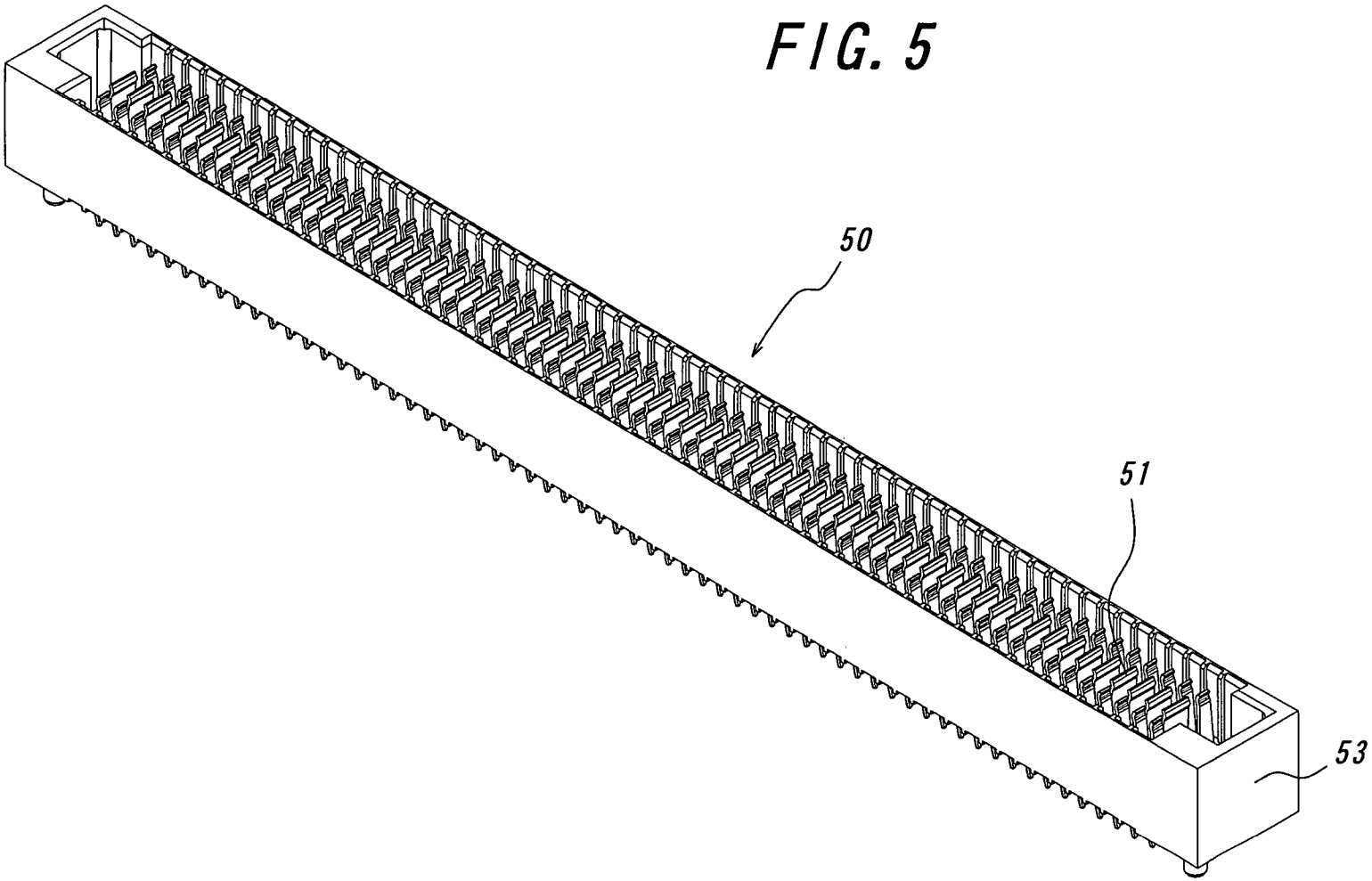
FIG. 5 is a perspective view of a plug connector constructing the typical electrical connector according to the invention.
Figure 6:
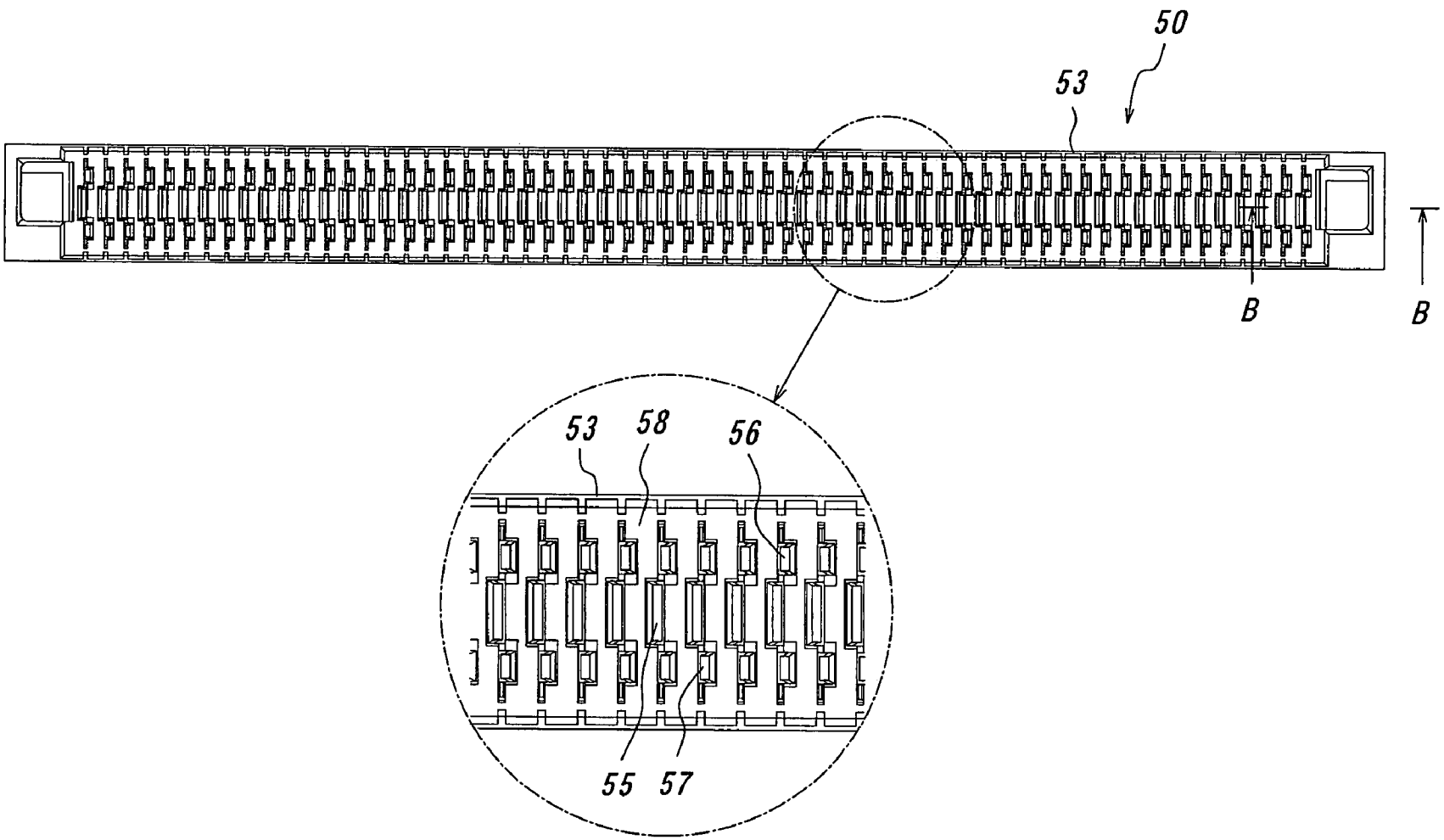
FIG. 6 is a front elevation of the plug connector shown in FIG. 5.
Figure 7:
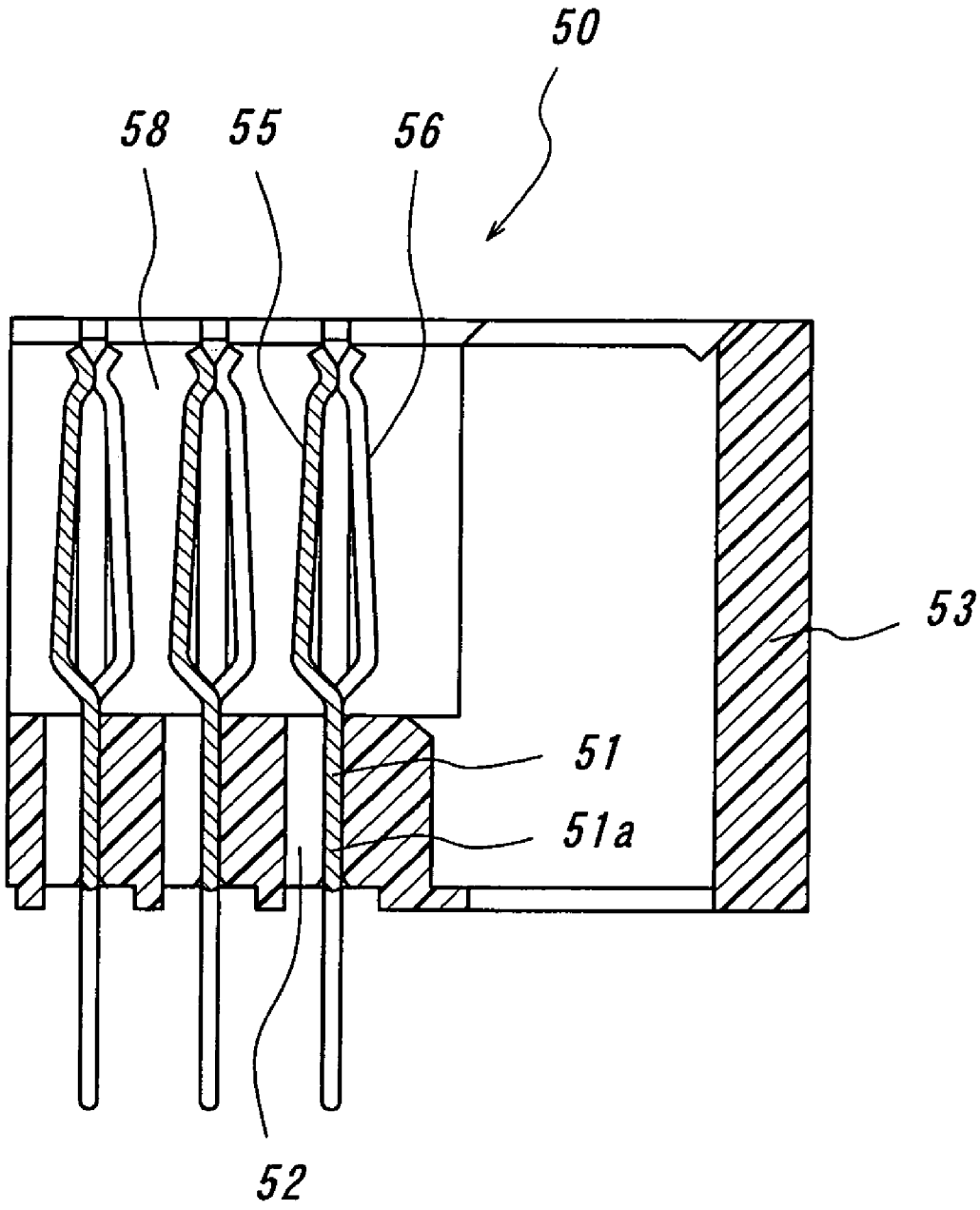
FIG. 7 is a sectional view of the plug connector taken along the line B—B in FIG. 6.
Figure 8:
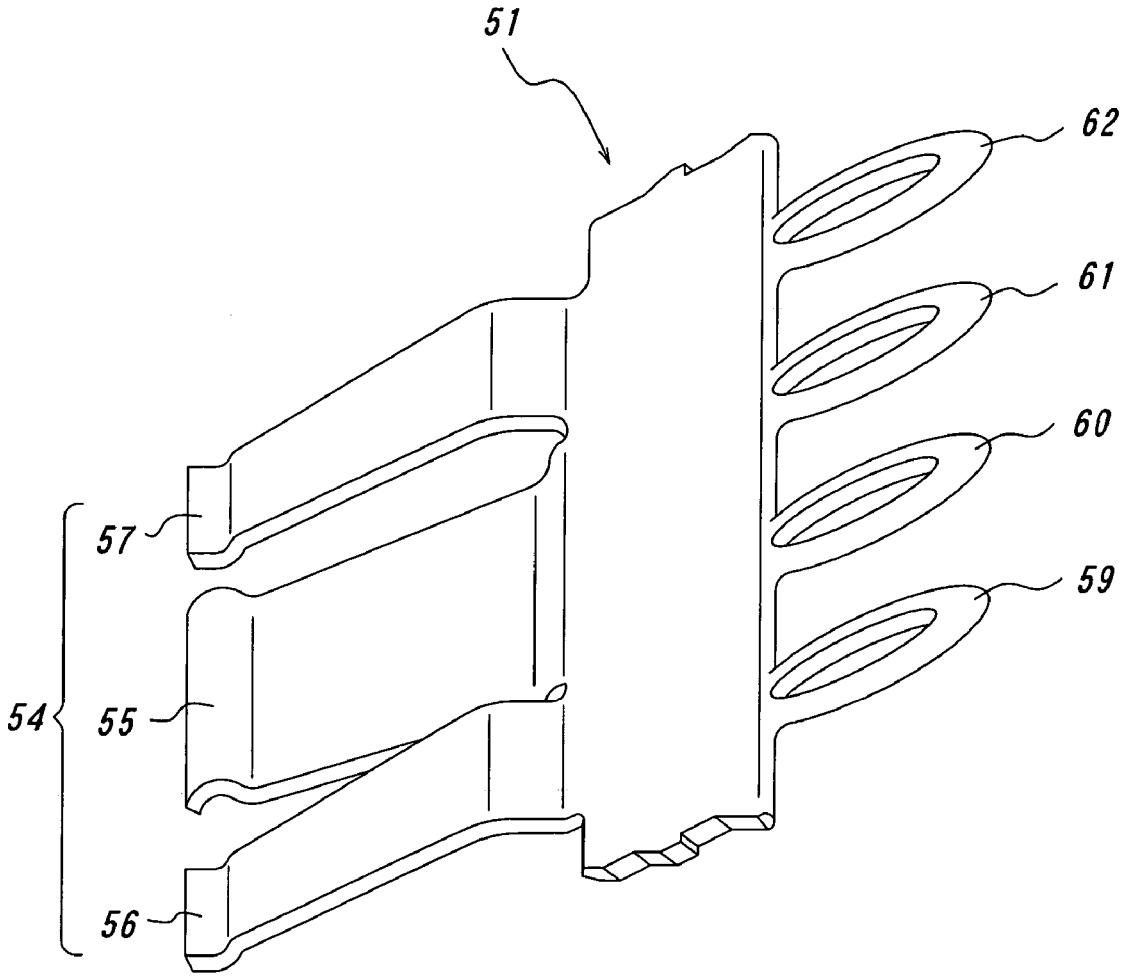
FIG. 8 is a perspective view of a plug contact used in the plug connector shown in FIG. 5.
Figure 9:
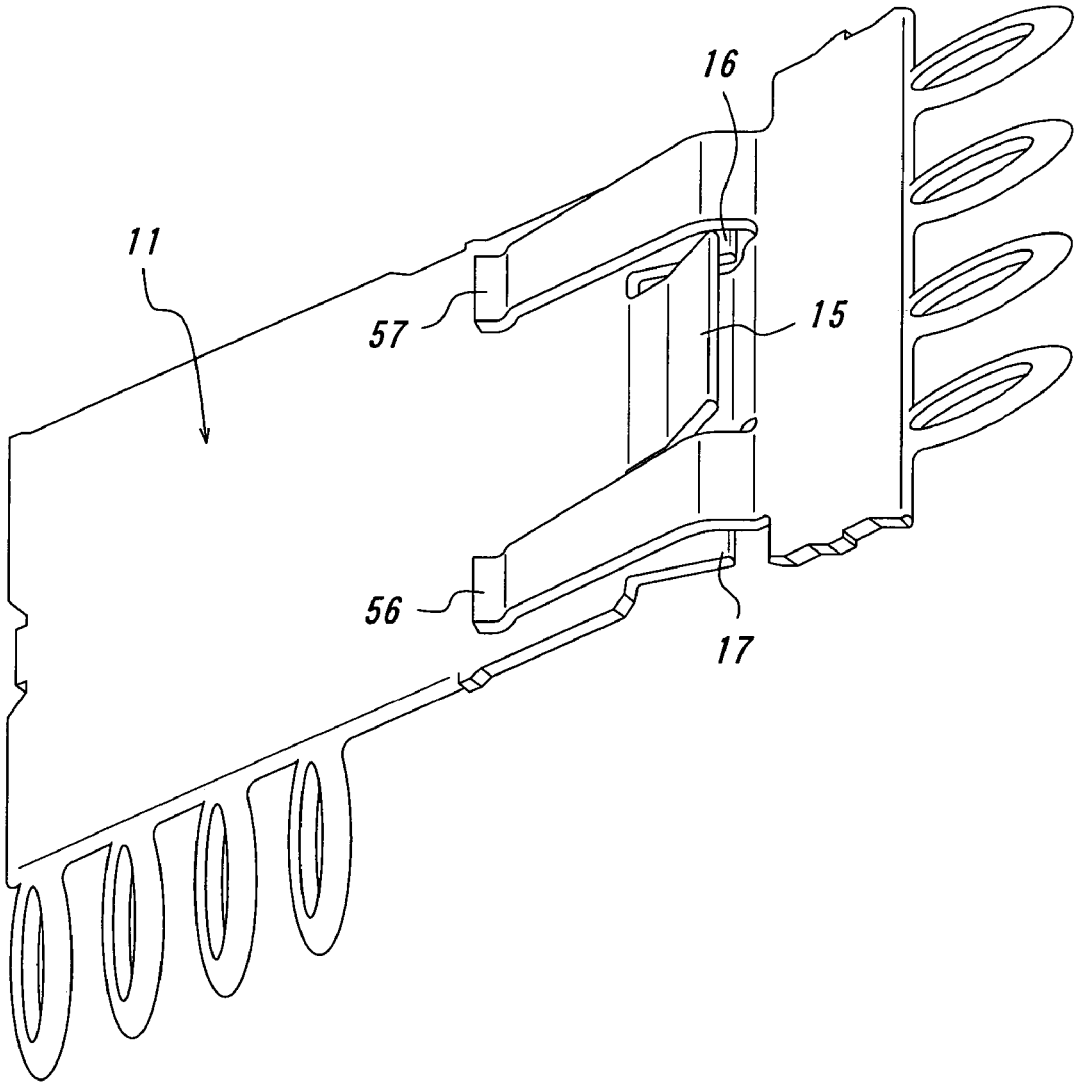
FIG. 9 is a perspective view of the receptacle contact and the plug contact in a connected state when the receptacle connector and the plug connector are connected to each other.

Preferred embodiments for carrying out the present invention will be explained with reference to the drawings hereinafter. FIGS. 1 and 2 are a perspective and a front view of a receptacle connector constructing a typical electrical connector according to the present invention. FIG. 3 is a sectional view of the receptacle connector taken along the line A—A in FIG. 2. FIG. 4 is a perspective view of a receptacle contact used in the receptacle connector shown in FIG. 1. FIGS. 5 and 6 are a perspective and a front view of a plug connector constructing the typical electrical connector according to the present invention. FIG. 7 is a sectional view of the plug connector taken along the line B—B in FIG. 6. FIG. 8 is a perspective view of a plug contact used in the plug connector shown in FIG. 5. FIG. 9 is a perspective view illustrating the receptacle and plug contacts in a connected state.

The electrical connector according to the invention comprises the receptacle connector 10 and the plug connector 50.

The receptacle connector 10 includes at least one plate-shaped receptacle contact 11 made of a conductive material such as, for example, brass, beryllium copper, phosphor bronze and the like, and a first housing 13 having at least one first through-hole 12 for accommodating the receptacle contact 11 and made of an insulating material such as, for example, polybutylene terephthalate (PBT), polyamide (66 PA or 46 PA), liquid crystal polymer (LCP), polycarbonate (PC) and the like and combination thereof.

The plug connector 50 includes at least one plate-shaped plug contact 51 made of a conductive material such as, for example, brass, beryllium copper, phosphor bronze and the like, and a second housing 53 having at least one second through-hole 52 for accommodating the plug contact 51 and made of an insulating material such as, for example, polybutylene terephthalate (PBT), polyamide (66 PA or 46 PA), liquid crystal polymer (LCP), polycarbonate (PC) and the like and combination thereof.

In the electrical connector according to the invention, at least three branched contact portions are provided in staggered form on at least one of front end portions 14 or 54 of the receptacle and plug contacts 11 and 51.

While the three staggered branched contact portions are provided on both the front end portions of the receptacle and plug contacts 11 and 51 in FIGS. 1 and 5, it will be apparent that the three staggered branched contact portions may be provided only on either of the front end portions 14 and 54 of the contacts 11 and 51.

In the case that the staggered branched contact portions are provided on both the front end portions 14 and 54 of the receptacle and plug contacts 11 and 51, the branched contact portions of the receptacle and plug contacts 11 and 5 1 are preferably the same in number and adapted to be engaged with each other. Under such conditions, the numbers of the respective branched contact portions may be more than three, but preferably an odd number in view of stabilization in contact.

In the receptacle connector 10 shown in FIG. 1, the front end portion of the receptacle contact 11 is formed with the branched contact portions 15 to 17 (FIG. 4), among which the main branched contact portion 15 located at the middle is wider than the side branched contact portions 16 and 17. In fact, preferably the width of the main branched contact portion 15 is 1.5 to 2.5 times the widths of the side branched contact portions 16 and 17.

Moreover, in the plug connector 50 shown in FIG. 5, the front end portion of the plug contact 51 is formed with the branched contact portions 55 to 57 (FIG. 8), among which the main branched contact portion 55 located at the middle is wider than the side branched contact portions 56 and 57. In fact, preferably the width of the main branched contact portion 55 is 1.5 to 2.5 times the widths of the side branched contact portions 56 and 57.

With the receptacle contact 11, it is preferable to form the main branched contact portion 15 and the side branched contact portions 16 and 17 so as to diverge or open at respective positions on the side of the front end portion when viewed from one side of the contact, with a view to obtaining good guidance when the plug contact 51 is being brought into engagement with the receptacle contact 11. Preferred methods for forming the branched contact portions 15, 16 and 17 of the receptacle contacts include press-working of known technique.

With the plug contact 51, it is preferable to form the main branched contact portion 55 and both the side branched contact portions 56 and 57 to converge or close when viewed from one side of the contact. In other words, these contact portions exert their springy forces in directions closing themselves to each other at respective positions when viewed from one side of the contact. Particularly, the contact portions of the plug contact 51 are each preferably formed with an arcuately curved surface in order to achieve stable electric contact with the contact portions of the receptacle contacts 11. Preferred methods for forming the branched contact portions 55 to 57 of the plug contact 51 include, for example, press-working of known technique.

In order to dissipate the heat of the receptacle contact 11 effectively, it is preferable to form the first through-hole 12 of the receptacle connector 10 so that at least one surface of the receptacle contact 11 does not contact the first housing 13 over the full length of the contact 11. In the embodiment shown in FIG. 3, at the rear portion 11*a* of the receptacle contact 11, the one surface of the receptacle contact 11 does not contact the wall surface of the first housing 13 in the space of the first through-hole 12, and at the front portion 11*b* of the receptacle contact 11, both the surfaces of the receptacle contact 11 do not contact any wall surfaces of the first housing 13, with the result of effective heat dissipation of the receptacle contact 11.

The plug connector 50 has a plurality of plug contacts 51 and is formed with second through-holes 52 whose number is equal to the number of the plug contacts 51 for accommodating them. The second through-holes 52 of the plug connector 50 are short holes enough to accommodate only the rear portions 51*a* of the plug contacts 51 and the front end portions 54 of the plug contacts 51 are in an open space 58 which is common to the other plug contacts. This construction is preferable to achieve effective heat dissipation of the contacts.

It is preferable to design the plug contacts 51 and the second housing 53 so that at least one surfaces of the rear portions 51*a* of the plug contacts 51 do not contact the second housing 53 in order to promote the heat dissipation of the contacts 51.

Moreover, it is preferable to form the first and second through-holes 12 and 52 of the receptacle and plug connectors 10 and 50 to have cross-sections corresponding to the staggered configuration of the front end portions 14 and 54 of the contacts 11 and 51 in a manner enabling the front end portions to be fitted into the first and second through-holes 12 and 52.

While the described embodiment represents only one preferred form of the present invention, it will be understood that obviously modifications and variations are possible without departing from the scope of the present invention determined by the following claims. For example, the receptacle contact 11 illustrated in FIG. 4 is of a so-called "right angle type" in which four terminals 18 to 21 extend laterally from the contact 11, while the plug contact 51 shown in FIG. 8 is of a so-called "straight type" in which four terminals 59 to 62 extend rearward of the plug contact 51. However, the receptacle contact may be of "straight type", while the plug contact may be of "right angle type", or both the receptacle and plug contacts 11 and 51 may be of the same type. In addition, the numbers of the contacts 11 and 51 to be arranged in the respective connectors 10 and 50 and the numbers of the terminals to be provided on the respective contacts 11 and 51 are not limited to the numbers illustrated in the embodiment and may be increased or decreased if required.

The present invention can provide an electrical connector superior in stability of contact between the plug contacts and the receptacle contacts by forming at least one of front end portions of the plug and receptacle contacts in a proper shape.

Furthermore, according to the invention three branched contact portions are provided at each of the front end portions of the plug and receptacle contacts and these front end portions of the plug and receptacle contacts are coupled and engaged with each other, thereby more improving the stability of contact between the plug and receptacle contacts.

Furthermore, according to the invention the first through-holes of the receptacle connector are so formed that at least one surfaces of the receptacle contacts do not contact the first housing over the full lengths of the contacts, and/or the plug connector includes a plurality of plug contacts and is formed with second through-holes, the number of which is equal to that of the plug contacts, in a manner that the second through-holes are short holes so as to accommodate only the rear portions of the plug contacts and to permit their front portions to be in an open space common to all the plug contacts so that at least one surfaces of the rear portions of the plug contacts do not contact the second housing, thereby promoting the heat dissipation of the contacts even if they are overheated at high temperatures.

What is claimed is:

1. An electrical connector comprising a receptacle connector and a plug connector, said receptacle connector including a first housing made of an insulating material having at least one plate-shaped receptacle contact made of a conductive material and formed with a first through-hole for accommodating said plate-shaped receptacle contact, and said plug connector including a second housing made of an insulating material having at least one plate-shaped plug contact made of a conductive material and formed with a second through-hole for accommodating said plate-shaped plug contact, wherein at least three branched contact portions are provided in staggered form on both front end portions of said plug contact and said receptacle contact, and wherein the front end portions of said plug contact and said receptacle contact are of different shapes resulting in better mating contact between said plug contact and said receptacle contact and are better suited to convey a heavy current.

2. The electrical connector as set forth in claim 1, wherein said first through-hole of the receptacle connector is so formed that at least one surface of the receptacle contact does not contact the first housing over the full length of the contact.

3. The electrical connector as set forth in claim 1, wherein said first and second through-holes of the receptacle and plug connectors have cross-sectional shapes corresponding to the branched contact portions of the front end portions of the respective contacts, making it possible to fit said staggered branched contact portions into the first and second through-holes of the receptacle and plug connectors, respectively.

4. The electrical connector as set forth in claim 1, wherein said second housing of the plug connector includes a plurality of plug contacts and is formed with a plurality of second through-holes whose number is equal to that of the plug contacts for accommodating the plug contacts, and said second through-holes are short holes for accommodating only the rear portions of said plug contacts so that the front portions of said plug contacts are in an open space common to all the plug contacts.

5. The electrical connector as set forth in claim 4, wherein the second through-holes of the second housing of the plug connector are so formed that at least one surfaces of the rear portions of said plug contacts do not contact the second housing.

6. The electrical connector as set forth in claim 1, wherein said branched contact portions are also provided on the front end portion of said receptacle contact, whose number is equal to that of the branched contact portions provided on the plug contact so that said plug connector is connected to said receptacle connector in a manner that the front end portion of the plug contact is conducted by the front end portion of the receptacle contact to be coupled and engaged with each other.

7. The electrical connector as set forth in claim 6, wherein said receptacle contact is so formed that the main branched contact portion and both said side branched contact portions diverge at respective positions on the side of the front end portion when viewed from one side of the contact.

8. The electrical connector as set forth in claim 6, wherein said receptacle contact is so formed that the main branched contact portion and both said side branched contact portions diverge at respective positions on the side of the front end portion when viewed from one side of the contact.

9. The electrical connector as set forth in claim 6, wherein said plug contact is so formed that the main branched contact portion and both said side branched contact portions exert their springy forces in directions closing to each other at respective positions on the side of the front end portion.

10. The electrical connector as set forth in claim 1, wherein said three branched contact portions are provided at the front end portion of said contact, among which the main branched contact portion positioned at the middle is wider than the side branched contact portions positioned on opposite sides of said main branched contact portion, and said front end portions of said plug and receptacle contacts are engageable with each other.

11. The electrical connector as set forth in claim 10, wherein said receptacle contact is so formed that the main branched contact portion and both said side branched contact portions diverge at respective positions on the side of the front end portion when viewed from one side of the contact.

12. The electrical connector as set forth in claim 10, wherein said plug contact is so formed that the main branched contact portion and both said side branched contact portions exert their springy forces in directions closing to each other at respective positions on the side of the front end portion.

13. The electrical connector as set forth in claim 10, wherein said branched contact portions are also provided on the front end portion of said receptacle contact, whose number is equal to that of the branched contact portions provided on the plug contact so that said plug connector is connected to said receptacle connector in a manner that the front end portion of the plug contact is conducted by the front end portion of the receptacle contact to be coupled and engaged with each other.

14. The electrical connector as set forth in claim 13, wherein said receptacle contact is so formed that the main branched contact portion and both said side branched contact portions diverge at respective positions on the side of the front end portion when viewed from one side of the contact.

* * * * *